US007210404B2

(12) United States Patent
Minamoto et al.

(10) Patent No.: US 7,210,404 B2
(45) Date of Patent: May 1, 2007

(54) COMPRESSING AND BINDING DEVICE FOR ELASTIC MEMBER

(75) Inventors: Naoki Minamoto, Toyota (JP); Toru Kawabe, Anjo (JP); Tomoharu Iwata, Kariya (JP); Takeyuki Hayakawa, Nishio (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 0 days.

(21) Appl. No.: 11/128,282

(22) Filed: May 13, 2005

(65) Prior Publication Data

US 2005/0262640 A1 Dec. 1, 2005

(30) Foreign Application Priority Data

May 17, 2004 (JP) ..... 2004-145830
Nov. 11, 2004 (JP) ..... 2004-327574

(51) Int. Cl.
*B65B 13/20* (2006.01)
*B30B 7/04* (2006.01)

(52) U.S. Cl. ..... 100/3; 100/8; 100/232

(58) Field of Classification Search ..... 100/3, 100/7, 8, 179, 185, 186, 188 R, 214, 215, 100/232, 240, 244
See application file for complete search history.

(56) References Cited

U.S. PATENT DOCUMENTS 3,000,295 A * 9/1961 Fenton ..... 100/214
4,413,555 A * 11/1983 Swinney ..... 100/214
5,353,698 A * 10/1994 Robbins ..... 100/3
5,687,643 A * 11/1997 Felts et al. ..... 100/3
5,732,617 A * 3/1998 Lollini ..... 100/7
6,823,776 B1 * 11/2004 Olds ..... 100/41
2002/0148366 A1 * 10/2002 Sutton et al. ..... 100/34

FOREIGN PATENT DOCUMENTS

JP 2001-96265 4/2001

* cited by examiner

*Primary Examiner*—Lowell A. Larson
*Assistant Examiner*—Jimmy Nguyen
(74) *Attorney, Agent, or Firm*—Oblon, Spivak, McClelland, Maier & Neustadt, P.C.

(57) ABSTRACT

A compressing and binding device for a spring mattress includes a compression chamber in which a spring mattress is housed, a compression board member compressing the spring mattress in a parallel direction with a bed surface thereof to form a compressed article, and a binding device for binding the compressed article with string.

13 Claims, 11 Drawing Sheets

COMPRESSING AND BINDING DEVICE FOR ELASTIC MEMBER

This application is based on and claims priority under 35 U.S.C. § 119 to Japanese Patent Applications 2004-145830, filed on May 17, 2004, and 2004-327574, filed on Nov. 11, 2004, the entire contents of which are incorporated herein by reference.

FIELD OF THE INVENTION

This invention generally relates to a compressing and binding device for compressing and binding an elastic member. More specifically, the present invention relates to the compressing and binding device, which compresses a large elastic member, such as a spring mattress, so as to be a small piece and binds it.

BACKGROUND

A used spring mattress has been disassembled into combustible materials, such as an outer covering body or the like, and a spring unit, and the combustible materials are incinerate, and the springs are recycled as steels. For example, by used of a device that is disclosed in JP2001-96265A, the mattress has been disassembled by the device for separating and removing the outer covering body from the spring unit of a mattress. Specifically, such device includes transportation rollers for transporting the mattress in a predetermined direction, a couple of peeling plates for each peeling one side of an outer covering body, which covers one side of the spring unit, and also peeling another side of the outer covering body, which covers another side of the spring unit, from the corresponding spring unit of the mattress that is transported by the transportation rollers, and a couple of separating means which are each arranged at the opposite side with a predetermined space in the direction perpendicular to the transporting direction of the mattress in order to separate the outer covering body from the spring unit by sending out the outer covering body peeled by the plates while each holding one part and another part of the outer covering body.

Thus, even when the outer covering body is firmly bound together with the spring unit, the outer covering body can be separated from the spring unit by means of the device. Further, the spring unit and the outer covering body, which is separated from the spring unit, are transported respectively in the predetermined directions, and thus the separated spring unit and the outer covering body are further easily processed. Further, such separating operation can be continually conducted, as a result an efficiency on the separating operation can be enhanced.

However, because such used mattress, that will be put into the device so as to be disassembled, needs to be transported from a home or a hotel by a truck, and a space of a rear deck of the truck in which the used mattress is loaded is limited, and thus, transportation becomes inefficient.

A need exists for provide a device by which a spring mattress can be compressed into a small piece and bound so as to be easily disassembled.

SUMMARY OF THE INVENTION

According to an aspect of the present invention, a compressing and binding device for a spring mattress comprises a housing formed therein with a compression chamber into which a spring mattress is accommodated; a compression board member compressing the spring mattress in the compression chamber in a parallel direction with a bed surface of the spring matters and forming a compressed article; and a binding means for binding the compressed article with string means.

According to another aspect of the present invention, a compressing and binding device for an elastic member comprises a casing in which a chamber is formed so as to house an elastic member; a first plunger provided in the housing and moved in a first direction so as to press the elastic member housed in the chamber; a first driving means for moving the first plunger in the first direction; a second plunger provided in the housing and moved in a second direction so as to press the elastic member housed in the housing; a second driving means for moving the second plunger in the second direction; the second direction being orthogonal relative to the first direction; the elastic member being formed into a compressed article when compressed by both the first plunger in the first direction and the second plunger being in the second direction; and a binding means for binding the compressed article by means of a biding mechanism.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
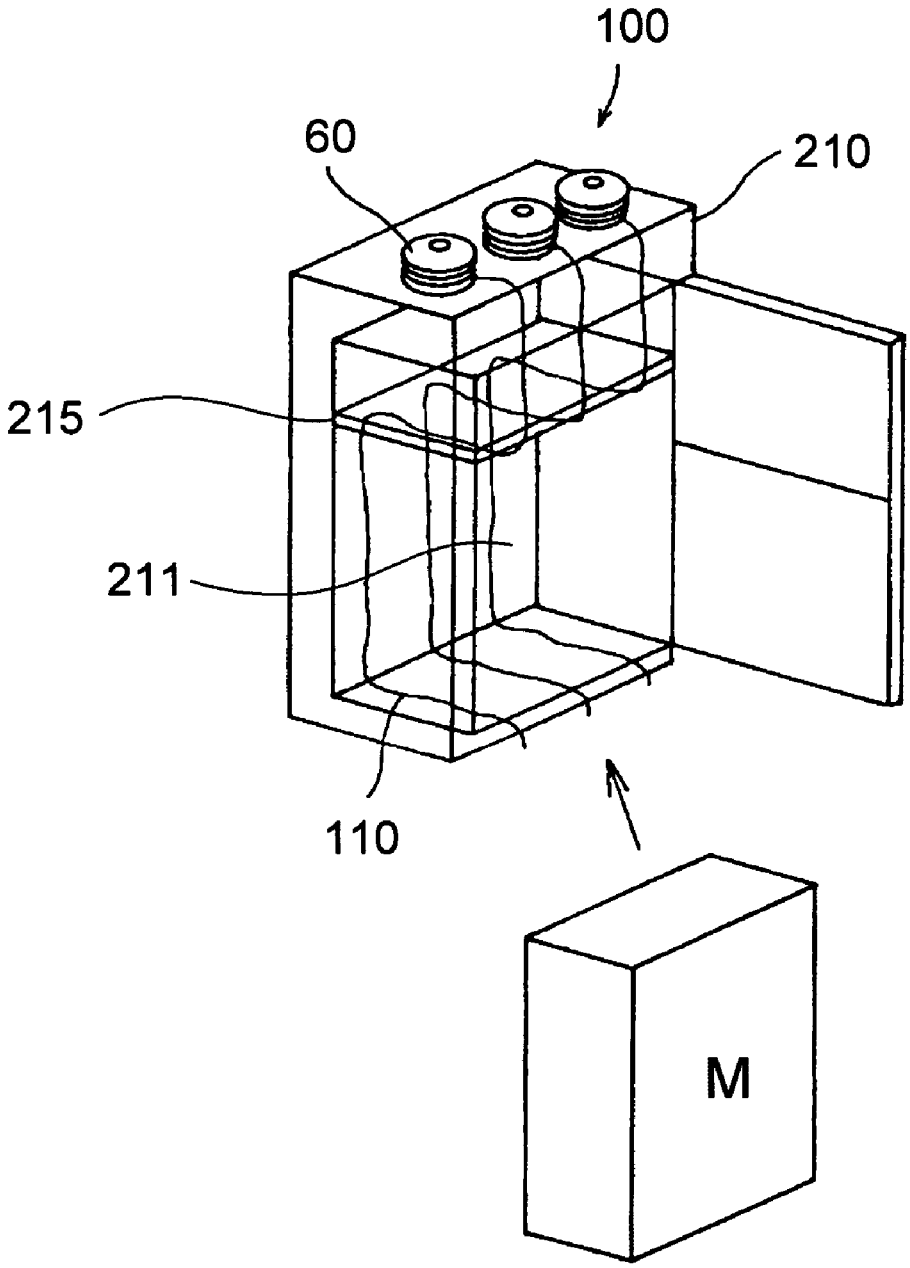
FIG. 1 illustrates a perspective view of a compressing and binding device for a spring mattress in the first embodiment according to the present invention.

Embodiments of the present invention will be explained in accordance with drawings attached hereto. As shown in FIG. 1, the compressing and binding device 100, according the first embodiment of the present invention, includes a housing 210 in which a the compression chamber 211 is formed. Specifically, string rollers 60 are provided at an upper portion of the housing 210, and each of string members 110 are extended from each of the string rollers 60 along a surface of a compression board member 215, which is provided in the compression chamber 211, and further extended along a back surface of the compression chamber 211, and then the string member 110 is extended toward outside of the housing 10.

Figure 2:
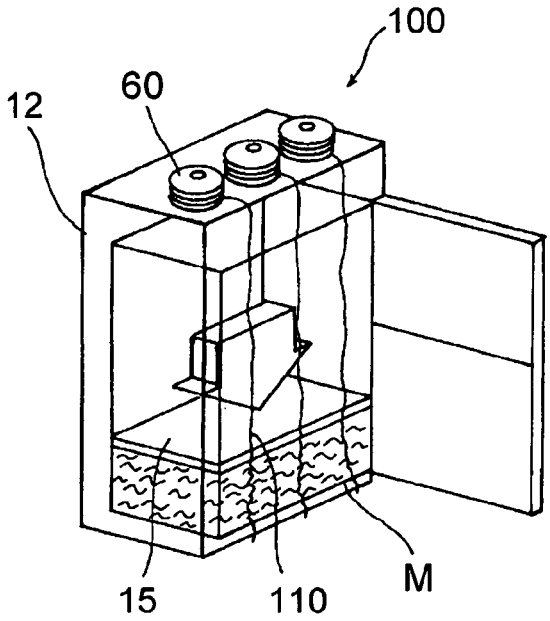
FIG. 2 illustrates a perspective view in which the spring mattress is compressed by the compressing and binding device illustrated in FIG. 1.
Figure 3:
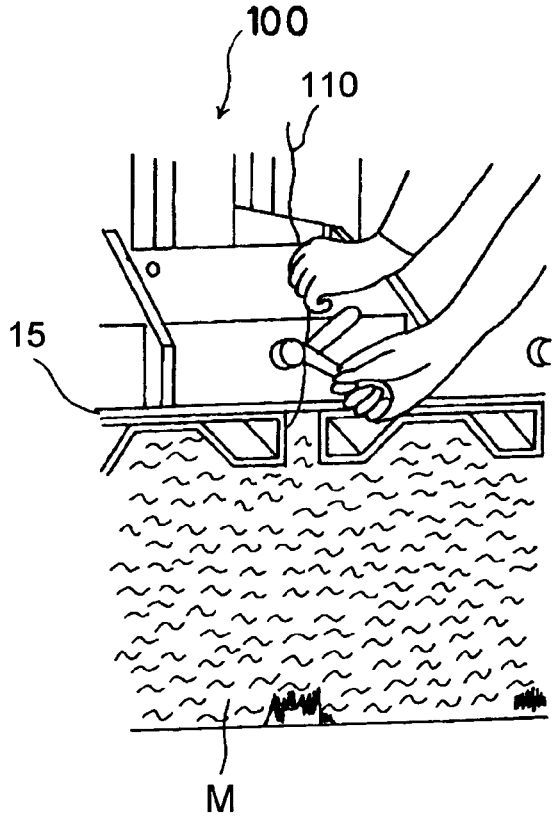
FIG. 3 illustrates a condition where a binding operation starts.
Figure 4:
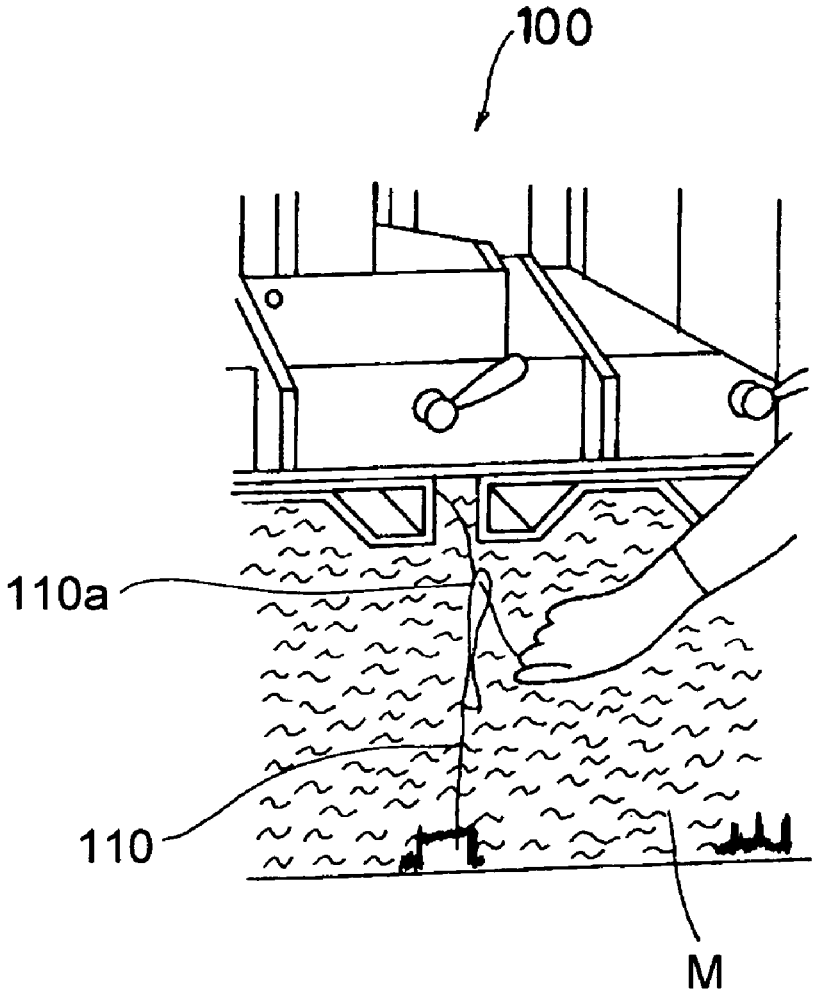
FIG. 4 illustrates a condition during the binding operation.
Figure 5:
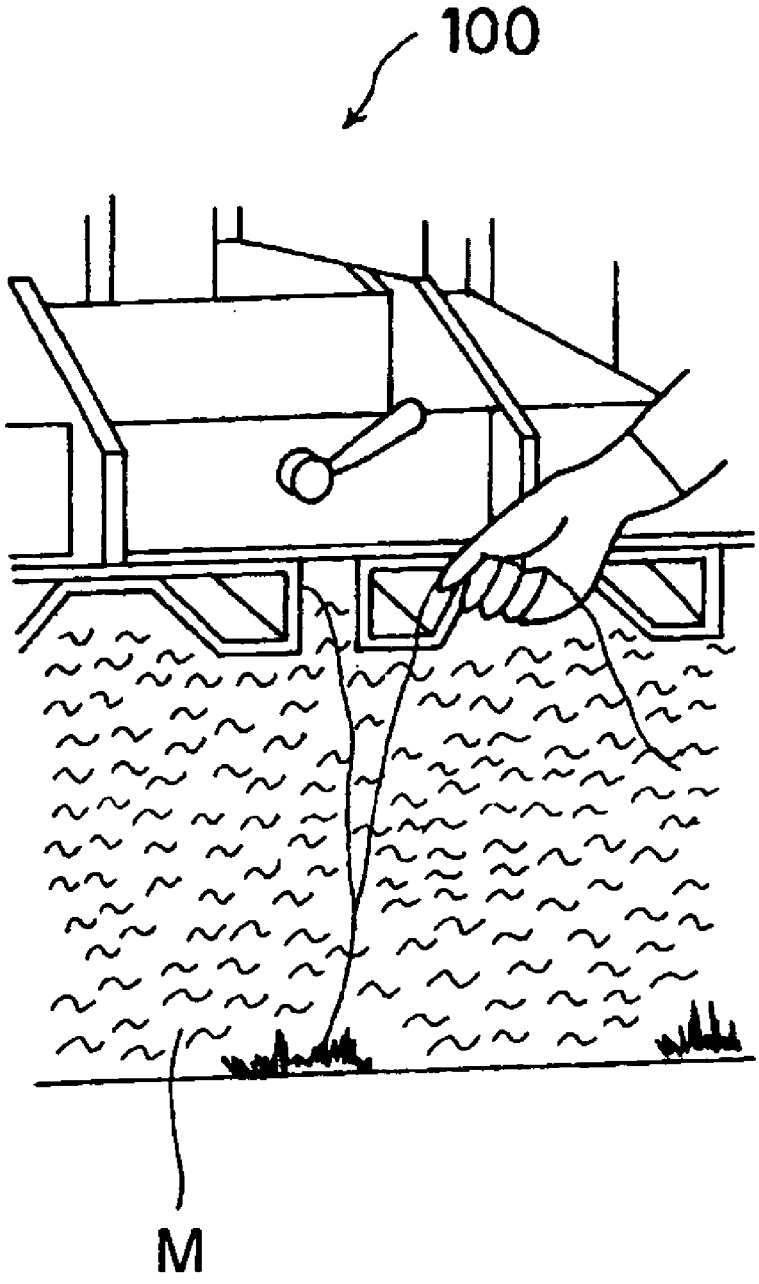
FIG. 5 illustrates a condition where the binding operation ends.

As shown in FIG. 1, a spring mattress M, which is put into the compression chamber 211 so as to be in a vertical position. Then, as shown in FIG. 2, the compression board member 215 moves down in order to reduce an internal volume in the compression chamber 211, and then a pressure applied in a parallel direction with a bed surface to the spring mattress M. Because the spring mattress M is vulnerable in a parallel direction with the bed surface, the spring mattress M can be compressed by means of a small pressure. Then, as shown in FIG. 3, after the spring mattress M is compressed, the string members 110 are cut by use of a cutting tool (not shown), then, as shown in FIG. 4, each of the upper end of the string members 110 is inserted into a looped end portion 110*a*, which is formed on each of the other ends of the string members 110, and then, as shown in FIG. 5, the upper end of the string member 110 is pulled so as to bind the compressed spring mattress M in the same manner as a slipknot (binding means).

Thus, the spring mattress M can be compressed so as to be quarter in volume, and bound in order to be transported effectively to an incinerator.

Further, because the spring mattress M is vulnerable to a pressure applied in a parallel direction with a bed surface to, the spring mattress M may be placed on its side in the compression chamber 11 and pressed in a horizontal direction.

Figure 6:
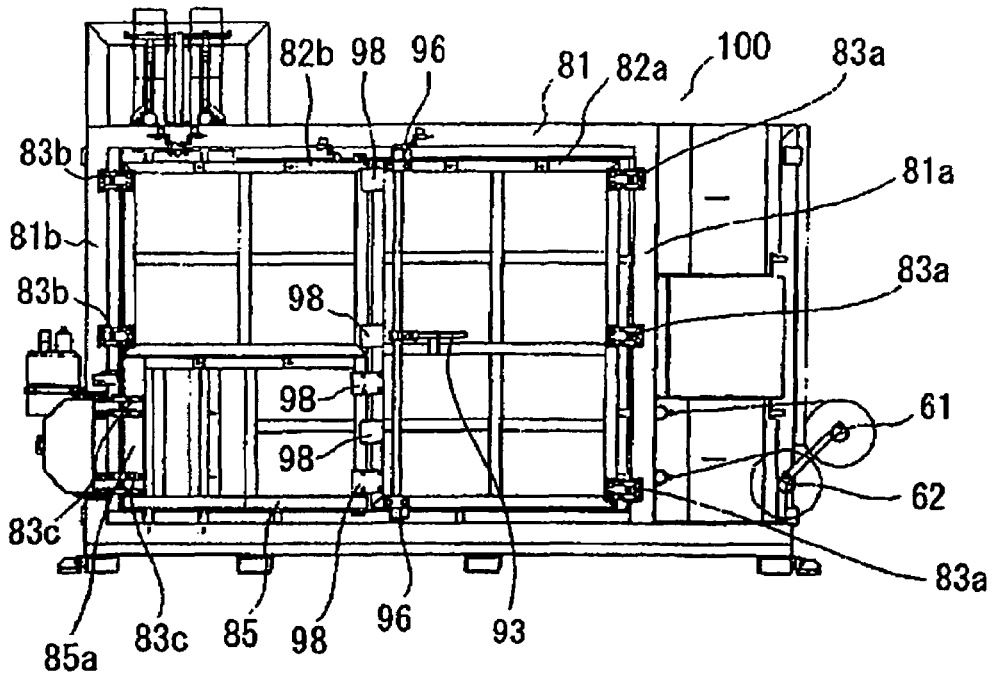
FIG. 6 illustrates a front view of a compressing and binding device for a spring mattress in the second embodiment according to the present invention.
Figure 7:
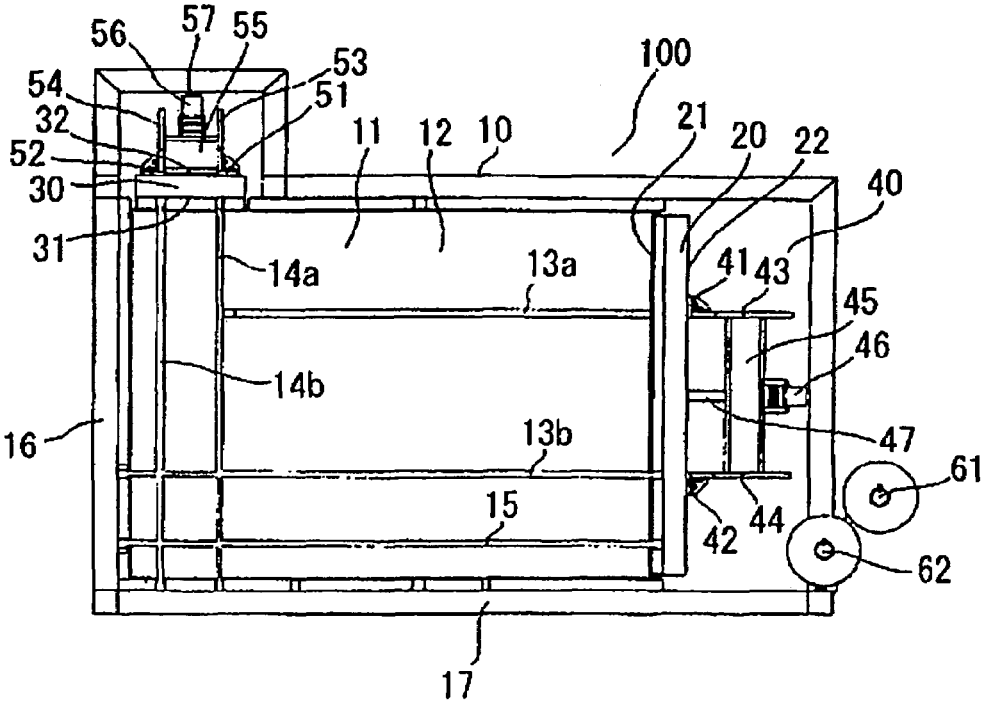
FIG. 7 illustrates a front view of the compressing and binding device illustrated in FIG. 6 form which doors are taken off.

FIG. 6 illustrates a front view of a compressing and binding device according to the second embodiment. The compressing and binding device compresses the spring mattress (elastic member) so as to be bound. FIG. 7 illustrates a front view of the compressing and binding device from which front covers are taken off for convenience.

As shown in FIG. 7, a compressing and binding device 100 in the second embodiment includes a casing 10, a first plunger 20 and a second plunger 30.

Specifically, the casing 10, formed in approximately a rectangular solid shape, includes an opening portion on its, front surface. In the second embodiment, the casing 10 is designed to be 3100 mm in width, 1200 mm in overall depth and 2500 mm in height, however, the size of the casing 10 is not limited to these values. Further, a housing 11 is formed in the casing 10 so as to be in a rectangular solid shape, and an elastic member such as a spring mattress is housed in the housing 11. The casing 10 is made of a steel material in order to enhance its stiffness.

A first plunger 20 is formed so as to extend in a vertical direction in FIG. 6 within a vertical length of the housing 11. Specifically, the first plunger 20 includes a front surface 21, which faces the housing 11, and a back surface 22, which is provided on the other side of the front surface 21. In such circumstances, when the compressing and binding device 100 is not operated (stand by state), the first plunger 20 is served as one of the walls (right wall in FIG. 2) of the housing 11. The movement of the first plunger 20 is limited by means of a guide, which is positioned on the backside of the compressing and binding device 100 in a vertical direction in FIG. 2 and an orthogonal direction in FIG. 2. Thus, the first plunger 20 can move only in a horizontal direction. A second plunger 30 is formed so as to extend in a horizontal direction in FIG. 6. Specifically, the second plunger 30 includes a front surface 31, which faces the housing 11, and a back surface 32, which is provided on the other side of the front surface 31. In such circumstances, when the compressing and binding device 100 is not operated (stand by state), the second plunger 30 is served as one of the walls (upper wall in FIG. 2) of the housing 11. The movement of the second plunger 30 is limited by means of a guide, which is positioned on the back side of the compressing and binding device 100 in a horizontal direction in FIG. 2 and an orthogonal direction in FIG. 2. Thus, the second plunger 30 can move only in a vertical direction.

Further, an upper bracket 41 and a lower bracket 42 are attached to the back surface 22 of the first plunger 20. Specifically, the upper bracket 41 is fixed to an upper portion of the back surface 22, and the lower bracket 42 is fixed to a lower portion of the back surface 22. More specifically, the upper bracket 41 is connected to an upper guide plate 43, which extends in a horizontal direction, and the lower bracket 42 is connected to a lower guide plate 44, which also extends in a horizontal direction. The upper guide plate 43 is connected by means of a first connecting rod 45 to the lower guide plate 44. Further, a first nut portion 46 is attached to the first connecting rod 45, and a first ball screw 47 is attached to the first nut portion 46. Specifically, the first nut portion 46 includes a female screw portion extending in a horizontal direction, and the first ball screw 47 included a male thread portion extending in a horizontal direction, and the first ball screw 47 is attached to the first nut portion 46 in circumstances where the male threads portion of the first ball screw 47 is screwed into the female screw portion of the first nut portion 46. Further, a first motor (not shown) is positioned concentrically with the first ball screw 47 in order to rotate the first ball screw 47. In this way, the first plunger 20 is moved in a horizontal direction by use of the upper bracket 41, the lower bracket 42, the upper guide plate 43, the lower guide plate 44, the first connecting rod 45, the first nut portion 46, the first ball screw 47 and the first motor, and such configuration is a first driving means 40.

In the same manner as the first plunger 20, a left bracket 52 and a right bracket 51 are attached to the back surface 32 of the second plunger 30. Specifically, the left bracket 52 is fixed to a left portion of the back surface 32, and the right bracket 51 is fixed to a right portion of the back surface 32. More specifically, the right bracket 51 is connected to a right guide plate 53, which extends in a vertical direction, and the left bracket 52 is connected to a left guide plate 54, which also extends in a vertical direction. The right guide plate 53 is connected by means of a second connecting rod 55 to the left guide plate 54. Further, a second nut portion 56 is attached to the second connecting rod 55, and a second ball screw 57 is attached to the second nut portion 56. Specifically, the second nut portion 56 includes a female screw portion extending in a vertical direction, and the second ball screw 57 included a male thread portion extending in a vertical direction, and the second ball screw 57 is attached to the second nut portion 56 in circumstances where the male threads portion of the second ball screw 57 is screwed into the female screw portion of the second nut portion 56. Further, a second motor (not shown) is positioned concentrically with the second ball screw 57 in order to rotate the second ball screw 57. In this way, the second plunger 30 is moved in a vertical direction by use of the right bracket 51, the left bracket 52, the right guide plate 53, the left guide plate 54, the second connecting rod 55, the second nut portion 56, the second ball screw 57 and the second motor, and such configuration is a second driving means 50.

As shown in FIG. 7, horizontal slits 13*a* and 13*b*, and vertical slits 14*a* and 14*b* are formed on a back surface wall 12 of the casing 10. Specifically, the horizontal slits 13*a* and 13*b* are positioned in parallel in a circumstance where the back surface wall 12 is divided into three portions in a vertical direction. More specifically, the horizontal slit 13*a* is formed so as to be at a same level in height as the position of the upper guide plate 43, which is connected to the first plunger 20. In the same manner, the horizontal slit 13*b* is formed so as to be at a same level in height as the position of the lower guide plate 44 that is connected to the first plunger 20. Thus, the first plunger 20 can move in a vertical direction in circumstances where the upper guide plate 43 is inserted into the horizontal slit 13*a*, and the lower guide plate 44 is inserted into the horizontal slit 13*b*.

On the other hand, the vertical slits 14*a* and 14*b*, are positioned in parallel in a circumstance where the back surface wall 12 is divided into three portions in a horizontal direction at a left portion of the back surface wall 12 in FIG. 6. The vertical slit 14*a* is formed so as to be at a same level as the position of the right guide plate 53, which is connected to the second plunger 30. In the same manner, the vertical slit 14*b* is formed so as to be at a same level as the position of the left guide plate 54 that is connected to the second plunger 30. Thus, the second plunger 30 can move in a horizontal direction in circumstances where the right guide plate 53 inserts into the vertical slit 14*a*, and the left guide plate 54 inserts into the vertical slit 14*b*. Thus, the second plunger 30 can move in a horizontal direction in circumstances where the right guide plate 53 is inserted into the vertical slit 14*a*, and the left guide plate 54 is inserted into the vertical slit 14*b*.

Figure 8:
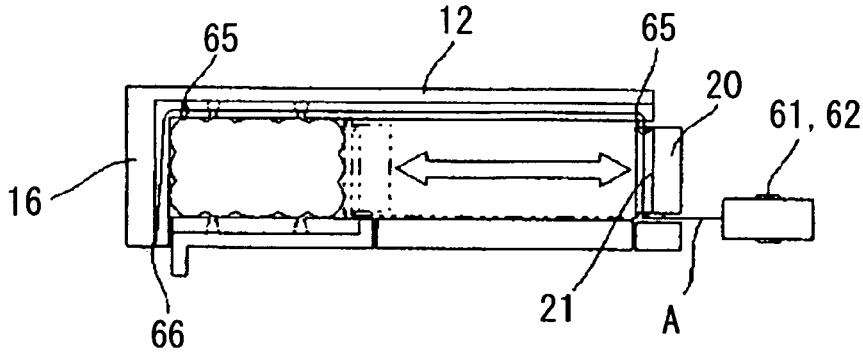
FIG. 8 illustrates a flat view indicating the inner portion of the compressing and binding device illustrated in FIG. 6

As shown in FIG. 7, a slit portion 15 is also formed in addition to horizontal slits 13*a* and 13*b* in a horizontal direction on the back surface wall 12 of the casing 10. The groove portion 15 or the horizontal slit 13*b*, which is positioned at lower than the horizontal slit 13*a*, serves as a horizontal direction string guiding groove for guiding a string so as to bind the compressed elastic member in a horizontal direction. Further, two rollers 61 and 62, to which string is winded, are mounted to the right-bottom portion of the casing as shown in FIG. 6. The string winded to the rollers 61 and 62 is extended within the housing 11 and served as a binding means for binding the compressed elastic member FIG. 8 illustrates a cross section seen from a top of the compressing and binding device 100. As shown in FIG. 8, a string A extended from the rollers 61 and 62 passes through the front surface 21 of the first plunger 20, then, the string A is hooked to an intermediate holding portion 65, and further extended in a different direction so as to be guided by the horizontal direction string guiding groove. The string A is hooked to another intermediate holding portion 65 at a connected portion between the back surface wall 12 and a left wall portion 16, and further extended in a different direction so as to pass through the left wall portion 16. Finally, the string A is bound to a stopper 66, such as a spring, positioned on a front portion of the left wall portion 16.

Figure 9:
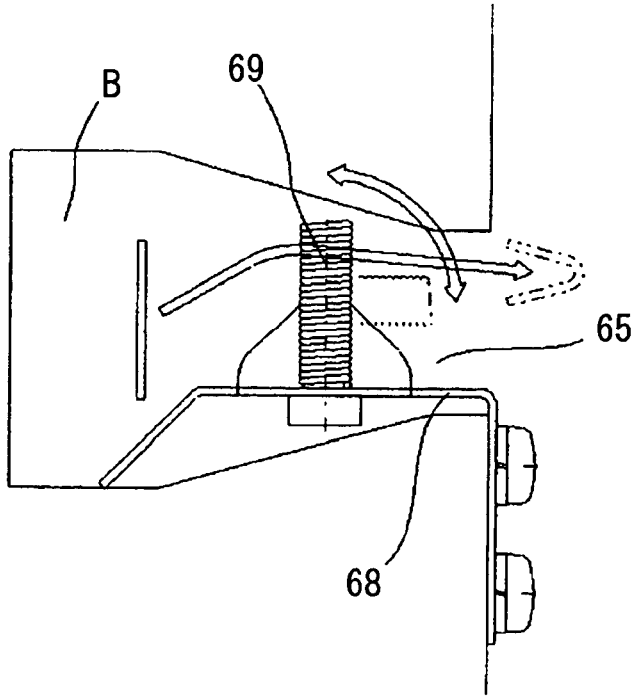
FIG. 9 illustrates a schematic view of a holding portion according to the second embodiment.

FIG. 9 illustrates a structure of the intermediate holding portion 65. As shown in FIG. 9, the intermediate holding portion 65 includes a recessed portion B into which a part of a bracket 68 is inserted, and a spring member 69 is provided on the bracket 68. The string A is hooked to the spring member 69. Because the spring member 69 can be deformed, the string A, which is held by the spring member 69, can be detached from the spring member 69 by pulling the string A so as to deform the spring member 69 as shown in a dotted line in FIG. 9.

Figure 10:
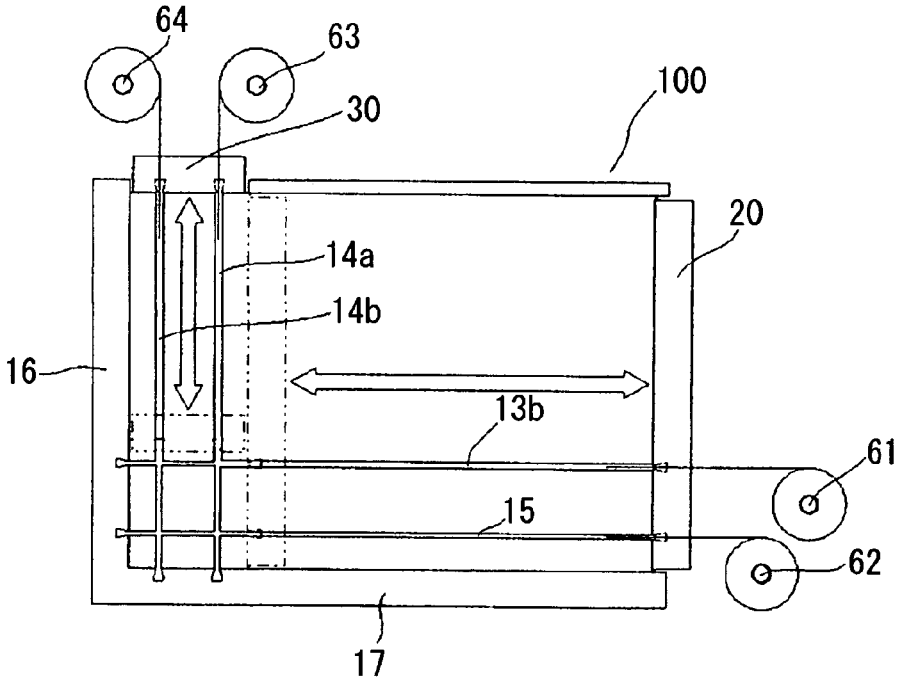
FIG. 10 illustrates a schematic view indicating an actuation of a first plunger and a second plunger of the compressing and binding device according to the second embodiment.

The vertical slits 14*a* and 14*b* serves as a vertical direction string guiding groove for guiding a string so as to bind the compressed elastic member in a vertical direction. Further, two rollers 63 and 64, to which the string is winded, are mounted to the left-upper portion of the casing 10 as shown in FIG. 10. The string winded to the rollers 63 and 64 is extended in the housing 11 and served as the binding means for binding the compressed elastic member. A string extended from the rollers 63 and 64 passes through the front surface 31 of the second plunger 30, then, the string is hooked to a intermediate holding portion 65, and further extended in a different direction so as to be guided by the vertical direction string guiding groove. The string is hooked to another holding portion at a connected portion between the back surface wall 12 and a bottom wall 17, and further extended in a different direction so as to pass through the bottom wall 17. Finally, the string A is bound to a stopper 66, such as a spring, positioned on a front surface portion of the bottom wall 17 left wall portion 16. The holding portion has a same structure as the intermediate holding portion 65 as shown in FIG. 9

As shown in FIG. 6, the casing 10 includes an opening portion on its front surface, and a doorframe 81 is fixed to the opening portion. To the doorframe 81, three door panels (a right door panel 82*a*, a left door panel 82*b* and an inner pressure releasing door panel 85) are fitted so as to be opened outward. The right door panel 82*a* includes a panel portion and reinforcing rods. Specifically, the panel portion of the right door panel 82*a* is formed in a rectangular shape and supported at three portions by means of the hinge members 83*a* to a frame body 81*a*, which is a right portion of the doorframe 81. The reinforcing rods are provided to the panel portion so as to be in a gridiron form in order to reinforce the right door panel 82*a*. Thus, the right door panel 82*a* serves as a cover unit for covering the right-half of the opening of the housing 11. On the other hand, the left door panel 82*b* includes a panel portion and reinforcing rods. Specifically, the panel portion of the left door panel 82*b* is formed in a rectangular shape and supported at two portions by means of the hinge members 83*b* to a frame body 81*b*, which is a left portion of the doorframe 81. The reinforcing rods are provided in the panel portion so as to be in a gridiron form in order to reinforce the left door panel 82*b*. Thus, the left door panel 82*b* serves as a cover unit for covering the left-half of the opening of the housing 11.

The inner pressure releasing door panel 85 is fitted to the door frame 81 below the left door panel 82*b*. The inner pressure releasing door panel 85 includes a panel portion, which is fitted to a left-lower portion of the door frame 81, and reinforcing rods, which are provided in the panel portion so as to be in a gridiron form in order to reinforce the inner pressure releasing door panel 85. Further, two hinge portions 83*c* are provided to a frame body 85*a*, which is positioned on the left portion of the door frame 81.

Figure 11:
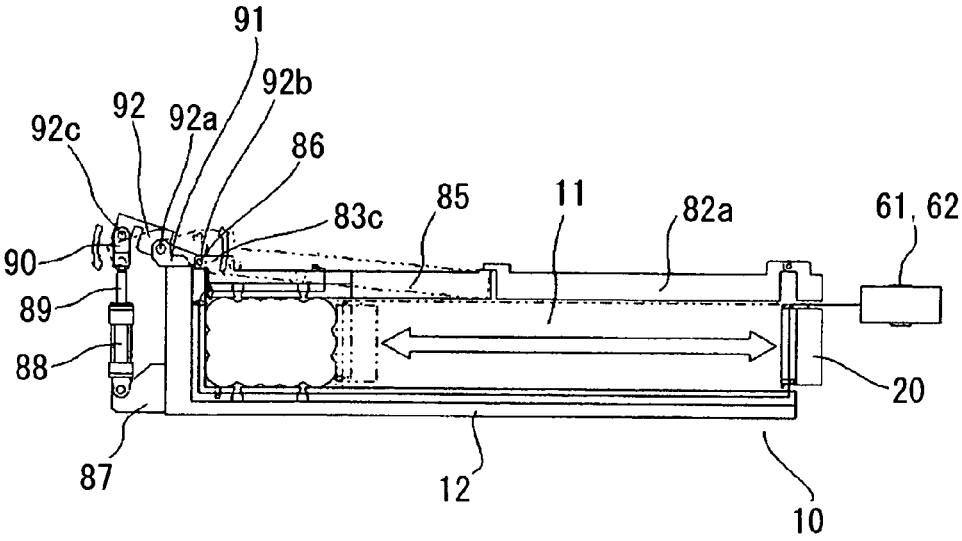
FIG. 11 illustrates a cross sectional schematic view indicating a structure and an actuation of an inner pressure releasing mechanism according to the second embodiment.

FIG. 11 illustrate a cross section for explaining a structure of the inner pressure releasing door panel 85. As shown in FIG. 11, a through hole is formed on the hinge portion 83*c* of the inner pressure releasing door panel 85, and a supporting pin 86 is inserted into the through hole. Thus, the hinge portion 83*c* can rotates relative to the supporting pin 86.

Further, a cylinder fixing bracket 87 is attached to a rear portion of the left wall portion 16 of the casing 10 so as to protrude outward, and a hydraulic cylinder 88 is fixed to the cylinder fixing bracket 87 in circumstances where a cylinder rod 89, which is inserted into the hydraulic cylinder 88, can be moved in a longitudinal direction of the casing 10 so as to be extended and contracted. Furthermore, a connecting bracket 90, on which a through hole is formed, is connected to one end portion of the cylinder rod 89.

Further, on a front portion of the left wall portion 16 of the casing 10, a rotating plate fixing bracket 91 is attached so as to protrude forward relative to the casing 10, and a rotating plate 92 is attached to the rotating plate fixing bracket 91.

Three through holes are formed on a central portion and both end portions of the rotating plate 92 (a central through hole 92*a*, a first through hole 92*b* and a second through hole 92*c*). The rotating plate 92 is rotatably supported by the rotating plate fixing bracket 91 by means of a pin inserted into the central through hole 92*a*. A supporting pin 86 is inserted into the first through hole 92*b* and a hole formed on the hinge portion 83*c* of the inner pressure releasing door panel 85 so that the inner pressure releasing door panel 85 can rotate relative to the first through hole 92*b* of the rotating plate 92. The rotating plate 92 is also rotatably supported by the connecting bracket 90 by means of a pin inserted into the second through hole 92*c* and a through hole formed on the connecting bracket 89.

Normally, the cylinder rod 89 of the hydraulic cylinder 88 is in an extended position, and in such circumstances, the cylinder rod 89 prevents by means of a valve that air flows within the hydraulic cylinder 88. When the cylinder rod 89 is in the extended position, the second through hole 92*c* is positioned forward relative to the central through hole 92*a*, and the first through hole 92*b* is positioned rear relative to the central through hole 92*a*. Further, when the cylinder rod 89 is in the extended position, the fixed so as to be extended, the position of the first through hole 92*b* is identical to a position, where a rotational axis of the inner pressure releasing door panel 85 is identical to a rotational axial axis of the left door panel 82*b* (a position shown in a solid line in FIG. 11), and this position is a basic position. Thus, inner pressure releasing door panel 85 is moved by a configuration that is comprised of the hinge member 83*c*, the inner pressure releasing door panel 85, the supporting pin 86, the cylinder fixing bracket 87, the hydraulic cylinder 88, the cylinder rod 89, the connecting bracket 90, the rotating plate fixing bracket 91 and the rotating plate 92, and such configuration comprises an inner pressure releasing mechanism 99 (door moving mechanism).

As shown in FIG. 6, a lock mechanism 93 is attached to the right door panel 82*a*. Specifically, the lock mechanism 93 includes a shaft 94, which extends in a vertical direction and is attached to an upper frame body and a lower frame body of the right door panel 82*a*. A lock lever 95 is attached to a central portion of the shaft 64 so as to be rotated integrally with the shaft 94. Each of door hook portions 96 is attached to an upper portion and a lower portion of the shaft 94. Further, to the each of the door hook portions 96, each of frame hook portions 97, which are fixed to the door frame 81, is engaged.

Figure 12:
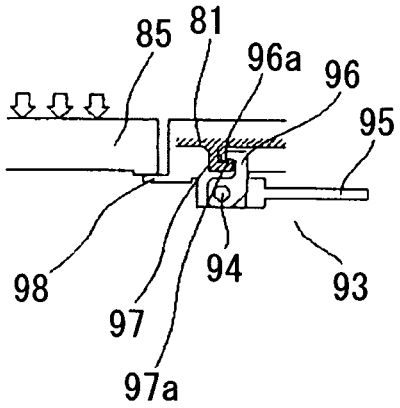
FIG. 12 illustrates a diagram indicating a structure of a lock mechanism according to the second embodiment.

The door hook portion 96 is engaged with the frame hook portion 97 as shown in FIG. 12. Specifically, the door hook portion 96 protrudes from the shaft 94 so as to be in a L-shape, and on a tip end of the door hook portion 96, a protrude portion 96*a* is formed so as to further protrude in an inward direction. On the other hand, the frame hook portions 97 are attached to the door frame 81, which is fixed to the casing 10. Each of the frame hook portions 97 are attached in corresponding to each of the door hook portion 96. As shown in FIG. 12, the frame hook portion 97 protrudes from the frame body so as to be in a L-shape, and on a tip end of the frame hook portion 97, a protrude portion 97*a* is formed so as to further protrude in an inward direction. Further, as shown in FIGS. 6 and 12, plural holding portions 98 are formed on the frame body of the right door panel 82*a*. Specifically, when each of the doors is closed, the left door panel 82*b* and the inner pressure releasing door panel 85 are pressed by the holding portions 98 of the right door panel 82*a*. Thus, the right door panel 82*a*, the left door panel 82*b* and the inner pressure releasing door panel 85 are locked by fixing the right door panel 82*a* to the door frame 81 by means of the lock mechanism 93.

An actuation of the mattress compressing and binding device 100 will be explained follow.

Figure 13:
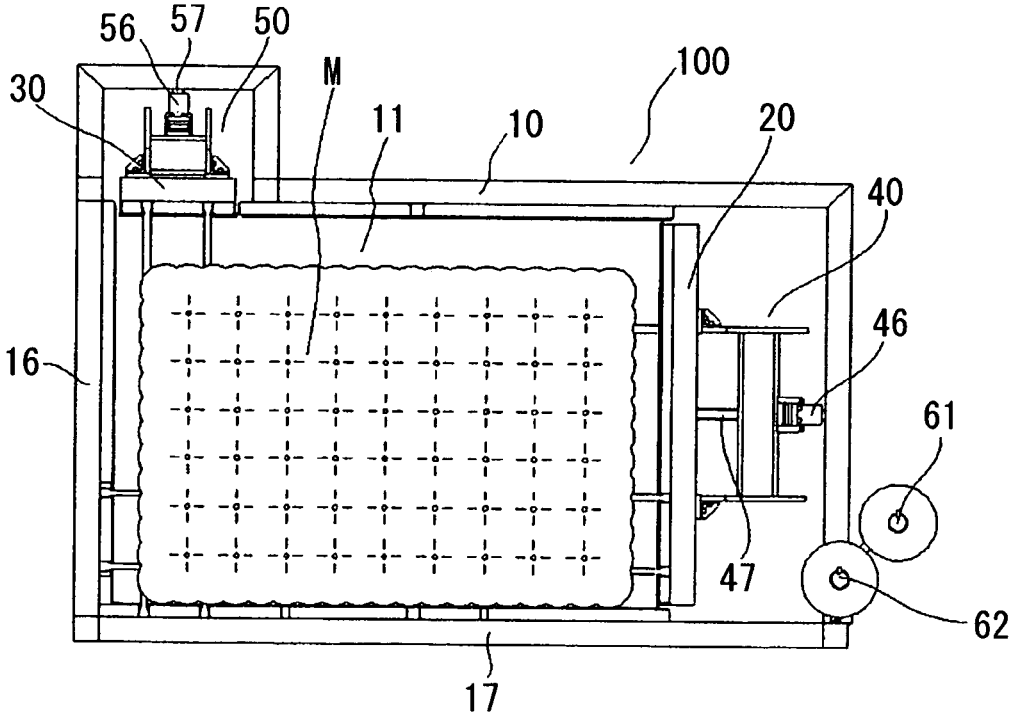
FIG. 13 illustrates a diagram in which the mattress is housed in a housing of the compressing and binding device according to the second embodiment.

First, the right door panel 82*a*, the left door panel 82*b* and the inner pressure releasing door panel 85 are opened, and the mattress M (elastic member) is housed in the housing 11 of the casing 10. A condition of the mattress M at this point is shown in FIG. 13. Then, the doors are closed. In this embodiment, because the holding portions 98 are formed on the frame body of the right door panel 82*a*, the left door panel 82*b* and the inner pressure releasing door panel 85 are closed first, and then right door panel 82*a* is closed so that the holding portions 98 are not engaged with the left door panel 82*b* and the inner pressure releasing door panel 85.

Then, the doors are locked by means of the lock mechanism 93. In this embodiment, by rotating the lock lever 95 so as to be in a state shown in FIG. 12, the door hook portion 96 is engaged with the frame hook portion 97, as a result, all the doors are locked. Then, an actuation button on a control panel (not shown) is pressed in order to actuate the device. Once the device is actuated, the first motor is driven so as to rotate the first ball screw 47. In accordance with the rotation of the first ball screw 47, the first ball screw nut 46 and the first plunger 20, which is connected to the first ball screw nut 46, are moved along with the first ball screw 47 in a horizontal direction. Then, the first plunger 20 is moved from a stand-by position shown in FIG. 7, in leftward horizontally within the housing 11.

As the first plunger 20 is moved in leftward, the mattress M housed in the housing 11 is pressed by the first plunger 20 and engaged with the left wall portion 16 at a left end thereof. Then, the first plunger 20 is further moved in leftward, and the mattress M is pressed so as to be in a vertically long shape. Then, the first plunger 20 is stopped short of a position where it interferes with an area in which the second plunger 30 moves in a vertical direction. The position of the first plunger 20 is detected by means of a limit switch or a proximity switch, and on the basis of the position detected by these switches, the first plunge 20 is controlled so as to be stopped. In this way, the mattress M is pressed in a horizontal direction as shown in FIG. 14.

Figure 14:
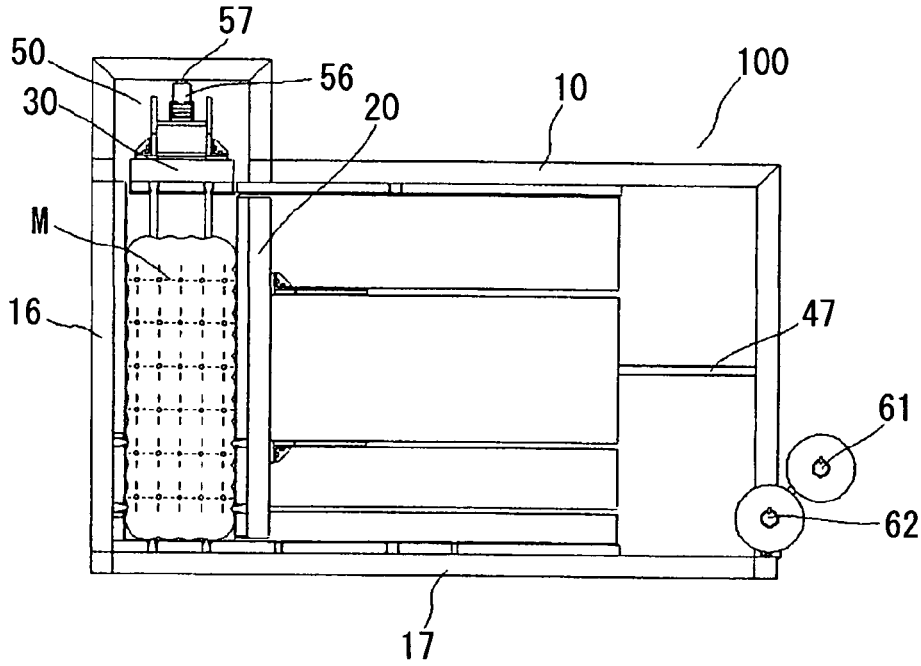
FIG. 14 illustrates a diagram in which the mattress is compressed by the first plunger in a horizontal direction within the housing according to the second embodiment.
Figure 15:
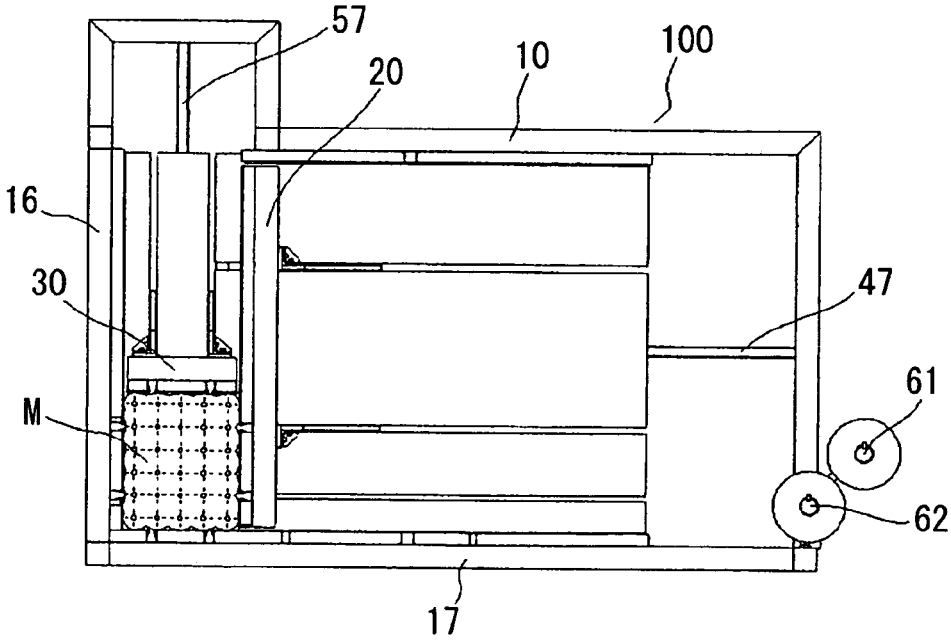
FIG. 15 illustrates a diagram in which the mattress is compressed by the first plunger in a horizontal direction and further compressed by the second plunger in a vertical direction according to the second embodiment.

After the mattress M is pressed in a horizontal direction, and the first plunger 20 is stopped at the stopped position as shown in FIG. 14, the second motor is driven. When the second motor is driven, while the first plunger 20 remains in the stopped position, the second ball screw 57 that is connected to the second motor, is rotated, and in accordance with the rotation of the second ball screw 57, the second ball screw nut 56 and the second plunger 30, which is connected to the second ball screw nut 56 is moved in a vertical direction along the second ball screw 57. Thus, the second plunger 30 is moved within the housing 11 from its stand-by position shown in FIG. 5 in a vertically-downward direction As the second plunger 30 is moved in a vertically-downward direction within the housing 11, the mattress, which has been compressed in a horizontal direction by the first plunger 20, is compressed in a vertical direction. When the mattress is compressed in a vertical direction so as to be third in volume, the second plunger 30 is stopped. The position of the second plunger 30 is detected by means of a limit switch or a proximity switch, and on the basis of the position detected by these switches, the second plunger 30 is controlled so as to be stopped. In this way, the mattress M is pressed in a vertical direction as shown in FIG. 15.

Thus, the mattress M is pressed by means of the first plunger 20 in a horizontal direction, and pressed by means of the second plunger 30 in a vertical direction so as to be in a small piece.

After the mattress is pressed by the first plunger 20 and the second plunger 30, the pressed mattress M is bound by means of a string member while the first plunger 20 and the second plunger 30 remain in the stopped position. At this point, the compressed mattress M is bound as follow. First, the pressed mattress M is bound in a horizontal direction by means of the string member that is provided within the horizontal direction string guiding groove. Specifically, the string member runs from the rollers 61 and 62 through the front surface 21 of the first plunger 20 and the horizontal direction string guiding groove of the back surface wall 12, and finally reaches the left wall portion 16. Thus, while the first plunger 20 is in the stopped position, the string member runs around the mattress M on its three surfaces (a surface that faces the front surface 21 of the first plunger 20, a surface that faces the back surface wall 12 of the casing 10, and a surface that faces the left wall portion 16). Thus, an operator can cut the string member at an appropriate point, and the end portions of the string portion, one is cut at an appropriate point, and the other is held at a holding portion 66 at the front portion of the left wall portion 16, are tied together through the inner pressure releasing door panel 85 so as to bind the mattress in a horizontal direction. Because the string member is hooked to the intermediate holding portion 65, which is comprised of the spring member 69, the string member can be taken off from the intermediate holding portion 65 by pulling out the string member so as to deform the spring member 69.

Then, the pressed mattress M is bound in a vertical direction by means of a string member that is provided within the horizontal direction string guiding groove. The pressed mattress M is bound in a vertical direction by means of the string member that is provided within the vertical direction string guiding groove. Specifically, the string member runs from the rollers 63 and 64 through the front surface 31 of the second plunger 30 and the vertical direction string guiding groove of the back surface wall 12, and finally reaches bottom wall 17. Thus, the operator can cut the string member at an appropriate point, and the end portions of the string member, one is cut at an appropriate point, and the other is held at a holding portion 66 at the front portion of the left wall portion 16, are tied together through the inner pressure releasing door panel 85 so as to bind the mattress in a vertical direction. Because the string member is hooked to the intermediate holding portion 65, which is comprised of the spring member 69, the string member can be taken off from the intermediate holding portion 65 by pulling out the string member so as to deform the spring member 69.

The pressed and bound mattress M is then removed from the housing 11. At this point, a repulsive force (inner pressure) of the mattress M, which is generated relative to the pressure applied to the mattress M, is applied to the doors. The inner pressure is applied in a direction in which the doors opens, however, because the doors are locked by means of the lock mechanism 93, the doors cannot be opened by the inner pressure. Further, while the inner pressure is applied to one of the doors, even when the operator tries to rotate the lock lever 95 without discretion, the lock lever 95 cannot be operated. Specifically, as shown in FIG. 12, when the doors are in a locked state, the door hook portion 96 is engaged with the frame hook portion 97. In such circumstances, when the inner pressure is generated by the mattress M, the inner pressure is applied to the inner pressure releasing door panel 85 and the left door panel 82*b*. Such inner pressure is further applied to the right door panel 82*a* via the holding portion 98. The inner pressure applied to the right door panel 82*a* forces the right door panel 82*a* so as to be opened, however, because the right door panel 82*a* is connected to the door hook portion 96 by means of the shaft 94, the door hook portion 96 is also moved so as to be opened. Then, the door hook portion 96 is tightly engaged with the frame hook portion 97, and the protrude portion 96*a* is also tightly engaged with the protrude portion 97*a*. Thus, while the door hook portion 96 is tightly engaged with the frame hook portion 97, the lock lever 95 cannot be rotated. Specifically, if the lock lever 95 is rotated while the door hook portion 96 is tightly engaged with the frame hook portion 97, the rotation of the door hook portion 96, which rotates in conjunction with the rotation of the lock lever 95, is interfered by the protrude portion of the frame hook portion 97. Thus, the lock lever 95 cannot be rotated while the inner pressure of ht mattress M is applied to the doors, as a result, the doors cannot be opened.

It is required to release the inner pressure when the compressed and bound mattress M is removed from housing 11. Such pressure can be released by actuating the inner pressure releasing mechanism as follow. First, the valve that is used to close a hydraulic path of the hydraulic cylinder 88 is opened so that air can flows in the hydraulic path of the hydraulic cylinder 88 so as to actuate the cylinder rod 89. On the other hand, because the inner pressure of the mattress M is applied to the inner pressure releasing door panel 85 so as to be opened, and one end of the rotating plate 92, which is supported by means of the supporting pin 86 together with the inner pressure releasing door panel 85, is also pressed in a front direction. By means of the force applied to the rotating plate 92 at one end thereof, the other end of the rotating plate 92, on which the second through hole 92*c* is formed, is rotated in a different direction (inward direction) relative to the pin inserted into the central trough hole 92*a*. Consequently, the connecting bracket 90, which is connected to the through hole 92*c* of the rotating plate 92, is moved in an inward direction, and then the cylinder rod 89 is moved in an inward direction so as to be retracted. When the valve is closed, the cylinder rod 89 is not actuated because air in the hydraulic cylinder 88 is sealed, however, when the valve is opened, the cylinder rod 89 is moved so as to be retracted. In such circumstances, when the level of the inner pressure applied by the mattress M to the door is relatively small, and the cylinder rod 89 cannot be actuated by means of only the inner pressure, a supplemental driving source can be used to actuate the cylinder rod 89.

Thus, when the cylinder rod 89 is retracted, the connecting bracket 90, which is attached to the end of the cylinder rod 89, and the other end of the rotating plate 92, which is connected to the connecting bracket 90, are rotated in an anticlockwise direction in FIG. 11 relative to the pin inserted into the central through hole 92*a*. Then, the one end of the rotating plate 92 is rotated in an anticlockwise direction relative to the pin inserted into the central through hole 92*a*, and thus, the hinge portion 83*c* of the inner pressure releasing door panel 85 which is connected to the one end of the rotating plate 92 is moved forward so as to be in a dotted line in FIG. 11. Thus, because the supporting point of the inner pressure releasing door panel 85 is moved forward, a supported portion of the inner pressure releasing door panel 85 is moved forward so as to enhance the volume in the housing 11 at the movement of the inner pressure releasing door panel 85. When the volume in the housing 11 is enhanced, the inner pressure by the mattress M is released, as a result, the inner pressure applied to the inner pressure releasing door panel 85 can be reduced or dissolve.

Figure 16:
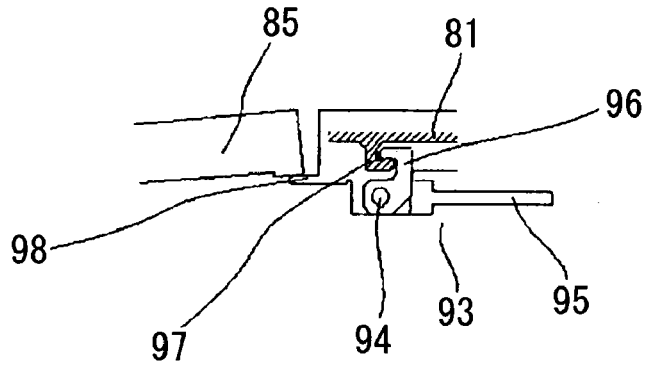
FIG. 16 illustrates a diagram which indicates a lock mechanism when an inner pressure of the mattress is released.
Figure 17:
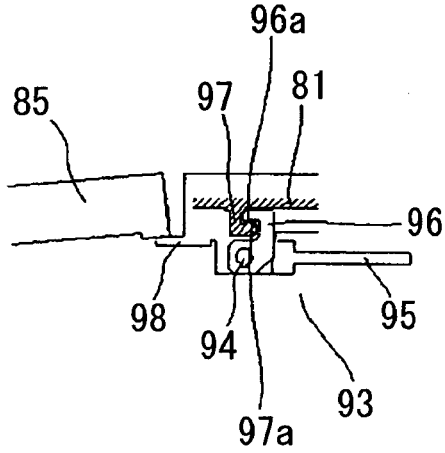
FIG. 17 illustrates a diagram in which the a gap is formed between the door hook portion and the frame hook portion by releasing the inner pressure of the mattress according to the second embodiment and FIG. 18 illustrates a diagram in which a lock lever is rotated after the inner pressure of the mattress is released according to the second embodiment.
Figure 18:
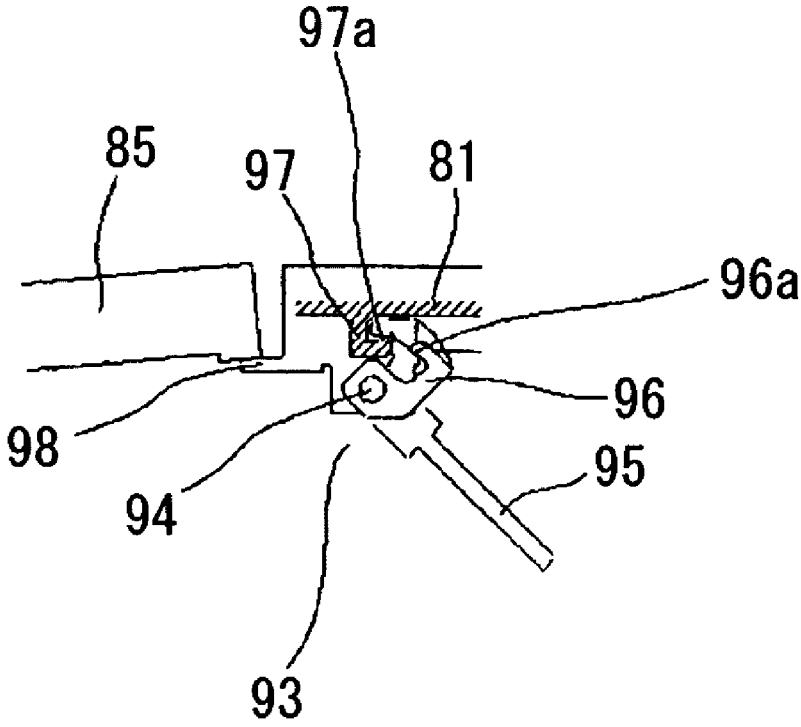

When the inner pressure applied to the inner pressure releasing door panel is dissolved, the inner pressure releasing door panel 85 is moved as shown in FIG. 16, and in such circumstances, the inner pressure applied to the lock lever 95 is also dissolved. In this state, by pressing the lock lever 95 inwardly, a gap is formed between the door hook portion 96 and the frame hook portion 97 as shown in FIG. 17, and thus, the protrude portion 96*a* of the door hook portion 96 can rotates without interfering with the protrude portion 97*a* of the frame hook portion, and the lock lever 95 can be rotated so as to unlock the doors. After the doors are opened, the compressed and bound body is removed from the housing 11.

In this way, according to the second embodiment, the compressing and binding device 100 includes the casing 10, the first plunger 20, the first driving means 40, second plunger 30, second driving means 50 and the binding mechanism (rollers 61, 62, 63, 64, the horizontal direction string guiding groove, the vertical direction string guiding groove, the intermediate holding portion 65, and the holding portion 66). Specifically, the housing 11, in which the mattress M is housed, is formed in the casing 10, the first plunger 20 can be moved in a horizontal direction within the space in the housing 11 so as to press the mattress M in a horizontal direction, the first driving means 40 moved the first plunger 20 in a horizontal direction, the second plunger 30 can be moved in a vertical direction within the space in the housing 11 so as to press the mattress M in a vertical direction, the second driving means 50 moves the second plunger 30 in a vertical direction, the binding mechanism binds the compressed mattress M housed in the housing 11. Thus, the mattress M can be pressed by the first plunger 20 in a horizontal direction, and further pressed by the second plunger 30 in a vertical direction, and then the pressed mattress M is bound so as to be in a small compressed and bound body. Thus, a lot of compressed and bound bodies can be loaded on the rear deck of the truck so as to improve the efficiency of materials transporting. Further, such compressed and bound bodies can be thrown into a melting furnace so as to recycle the spring of the mattress.

Further, the compressing and binding device 100 according to the second embodiment includes the inner pressure releasing mechanism (the inner pressure releasing door panel 85, the hinge member 83*c*, the hydraulic cylinder 88, the cylinder rod 89, the connecting bracket 90, the fixing bracket 91 and the rotating plate 92). Specifically, by means of the inner pressure releasing mechanism, the inner pressure applied to the door by the compressed mattress M when the mattress M is pressed and bound within the housing 11. Thus, the mattress can be safely removed from the housing 11 after by releasing the inner pressure in the housing by actuating the inner pressure releasing mechanism.

Further, the inner pressure releasing mechanism can also be served as a door moving mechanism, by which the door can be moved in a direction, wherein the inner pressure applied to the door can be released, as a result, the costs can be reduced. Furthermore, the compressing and binding device 100 includes the lock mechanism 93 so as to prevent the doors from opening while the inner pressure of the mattress M is applied to the door.

Thus, while the inner pressure is applied to the door, even when the operator tries to rotate the lock lever 95 without discretion, the lock lever 95 cannot be operated, as a result, the doors remain in a closed state.

According to the present invention, because the mattress is vulnerable against a force applied in a longitudinal direction, the spring mattress can be easily compressed so as to be approximately fourth in volume.

Thus, the mattress or the like can be compressed by means of the first plunger in the first direction, and then the elastic member is further compressed by means of the second plunger in the second direction that is orthogonal relative to the first direction, as a result, the compressed elastic member is bound by means of the binding mechanism so as to be in the small body. Thus, a lot of compressed and bound bodies can be loaded on the rear deck of the truck so as to improve the efficiency on transportation. Further, such compressed and bound bodies can be thrown into the melting furnace so as to be recycled.

The elastic member can be compressed in another directions if these directions are orthogonal oriented. Generally, the first direction is a horizontal direction, and the second direction is a vertical direction. Further, the first plunger is moved by means of the first driving means, and the second plunger is moved by means of the second driving means. Generally, a direct driving means such as a ball screw or a motor, or a hydraulic driving means such as a hydraulic cylinder or an air cylinder can be used as these driving means, however, another means may be used alternatively. The compressed elastic member can be automatically bound by means of the binding means. Further, a jig may be attached to the elastic member in order to bind the elastic member by the operator. If the elastic member is bound by means of the jig, the costs can be reduced.

Further, the casing includes the opening portion through which the elastic member, which has been compressed and bound can be removed, and the doors are attached to the opening portion so as to cover the opening. Even when the inner pressure is applied to the door, such inner pressure can be reduced by means of the inner pressure releasing mechanism, as a result it can be prevented that the door is broken due to such inner pressure. Thus, the inner pressure releasing mechanism can reduce the inner pressure applied to the door, however, the inner pressure releasing mechanism may completely release the inner pressure.

Further, the door is moved so as to reduce the inner pressure applied by the elastic member to the door, in other word, the space of the housing can be enhanced by moving the door so as to be opened. By means of the inner pressure releasing mechanism, the entire door can be moved. For example, the door may be moved by moving the supporting shaft of the door so as to move a part of the door about which the door can rotates. When the level of the inner pressure, which is applied by the compressed elastic member to the door is, relatively small, the supplemental driving source can be used to move the door. Thus, another door moving means can be used if the door is moved by means of any inner pressure of the elastic member.

The compressing and binding device includes the lock mechanism so as to prevent the doors from opening while the inner pressure of the elastic member is applied to the door. Thus, while the inner pressure is applied to the door, even when the operator tries to rotate the lock lever without discretion, the lock lever cannot be operated, as a result, the doors remain in a closed state.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. A compressing and binding device for an elastic member comprising:

a casing in which a chamber is formed so as to house the elastic member;

a first plunger provided in a housing and moved in a first direction so as to press the elastic member housed in the chamber;

a first driving means for moving the first plunger in the first direction;

a second plunger provided in the housing and moved in a second direction so as to press the elastic member housed in the housing;

a second driving means for moving the second plunger in the second direction;

the second direction being orthogonal relative to the first direction;

the elastic member being formed into a compressed article when compressed by both the first plunger in the first direction and the second plunger being in the second direction; and a binding means for binding the compressed article by means of a binding rnechanism, wherein the casing includes an opening portion from which the compressed and bound article is removed, a door is attached to the opening, and the compressing and binding device includes an inner pressure releasing mechanism operatively connected to the lower portion of the door for reducing an inner pressure applied to the door while the elastic member is being compressed and bound in the chamber.

2. The compressing and binding device for an elastic member according to claim 1, wherein the inner pressure releasing mechanism includes a door moving mechanism by which the door is moved in a direction so as to reduce the inner pressure.

3. The compressing and binding device for an elastic member according to claim 1 wherein a lock mechanism is attached to the door in order to prevent the door from being opened while the inner pressure is being applied to the door from the compressed article.

4. The compressing and binding device for an elastic member according to claim 1, wherein the door is a swing door.

5. The compressing and binding device for an elastic member according to claim 1, wherein the elastic member is a spring mattress having a bed surface.

6. The compressing and binding device for an elastic member according to claim 1, wherein the elastic member is a spring mattress having a bed surface and both of the first and second directions are in parallel with the bed surface of the spring mattress.

7. The compressing and binding device for an elastic member according to claim 1, wherein the binding of the compressed article is performed with a single string.

8. The compressing and binding device for an elastic member according to claim 1, wherein the binding of the compressed article is performed with a plurality of strings.

9. The compressing and binding device for an elastic member according to claim 1, wherein the formation of the compressed article from the elastic member brings a volume reduction by a factor of a predetermined value.

10. The compressing and binding device for an elastic member according to claim 9, wherein the predetermined value is a volume reduction factor of about

11. The compressing and binding device for an elastic member according to claim 5, wherein the compressions in the first and second directions are performed concurrently.

12. The compressing and binding device for an elastic member according to claim 1, wherein the compressions in the first and second directions are performed in succession.

13. The compressing and binding device for an elastic member according to claim 1, wherein the elastic member is housed in the chamber in vertically oriented mode.

* * * * *